United States Patent [19]

Theurer

[11] Patent Number: 4,953,467

[45] Date of Patent: Sep. 4, 1990

[54] TRACK SURFACING MACHINE WITH TRACK STABILIZATION

[75] Inventor: Josef Theurer, Vienna, Austria

[73] Assignee: Franz Plasser Bahnbaumaschinen-Industriegesellschaft m.b.H., Vienna, Austria

[21] Appl. No.: 343,072

[22] Filed: Apr. 26, 1989

[30] Foreign Application Priority Data

Sep. 15, 1988 [AT] Austria ..... 2270/88

[51] Int. Cl.[5] ..... E01B 27/00

[52] U.S. Cl. ..... 104/7.1; 104/7.3; 104/12

[58] Field of Search ..... 104/7.1, 7.2, 7.3, 12

[56] References Cited

U.S. PATENT DOCUMENTS 3,651,587 3/1972 Plasser et al. .
4,046,078 9/1977 Theurer .
4,046,079 9/1977 Theurer .
4,064,807 12/1977 Theurer .
4,282,663 8/1981 Theurer .
4,643,101 2/1987 Theurer .

FOREIGN PATENT DOCUMENTS 1191739 8/1985 Canada .
1006639 10/1965 United Kingdom .

*Primary Examiner*—Joseph F. Peters, Jr.
*Assistant Examiner*—Virna Lissi Mojica
*Attorney, Agent, or Firm*—Kurt Kelman

[57] ABSTRACT

A continuously advancing track surfacing machine for compacting a ballast bed comprises a power-actuated, vertically adjustable track stabilization assembly mounted on the machine frame between front and rear undercarriages supporting the machine frame on the track. The track stabilization assembly includes rail-engaging vibratory roller tools and a drive for pressing the roller tools into engagement with the facing gage sides of the track rails, and a track leveling reference system monitors the track level. A vertically adjustable plow arrangement for smoothing the ballast bed is mounted on the machine frame between the undercarriages and associated with the track stabilization assembly, the plow arrangement extending across the track at least from one of the tie ends to the opposite tie end.

6 Claims, 1 Drawing Sheet

TRACK SURFACING MACHINE WITH TRACK STABILIZATION

BACKGROUND OF THE INVENTION (1) Field of the Invention

The present invention relates to a continuously advancing track surfacing machine for compacting a ballast bed supporting a track consisting of two rails fastened to ties, the rails having facing gage sides and the ties having opposite ends, which comprises a machine frame, front and rear undercarriages supporting the machine frame on the track for mobility in an operating direction, a drive for propelling the machine frame along the track, and a power actuated, vertically adjustable track stabilization assembly mounted on the machine frame between the undercarriages, the track stabilization assembly including rail-engaging roller tools, drive means for pressing the roller tools into engagement with the facing gage sides of the rails and means for vibrating the roller tools. The machine further comprises a drive for vertically adjusting the track stabilization assembly and a track leveling reference system monitoring the track level.

(2) Description of the Prior Art

Machines of this type for compacting and dynamically stabilizing a ballast bed are disclosed in U.S. Pat. Nos. 4,046,078 and 4,046,079, dated Sept. 6, 1977. Such track surfacing machines are either coupled to intermittently advancing track leveling, lining and tamping machines or are operated immediately therebehind to settle the tamped ballast bed by further compaction. In this way, the dynamic ballast stabilization anticipates the lower track level which would be attained under the loads of the trains passing over the tamped track and solidly embeds the track ties in the stabilized ballast whereby the resistance against any lateral track displacement is increased. The track stabilization assembly disclosed in these patents may be used in the present track surfacing machine and comprises a tool carrier frame supported on the track rails by flanged rollers which are spread apart into pressing engagement with the facing gage sides of the rails. Gripping rollers are mounted on the tool carrier frame and may be pivoted into clamping engagement with the rail heads at the field sides thereof whereby each rail is firmly engaged between the flanged rollers and the gripping rollers. The tool carrier frame is subjected to vibrations extending transversely to the track and to vertically downwardly extending loads. These forces cause the firmly gripped track to be driven into the ballast bed, imparting a flowing motion to the ballast stones which re-orients the ballast stones and moves them closer together. This enhances the compaction of the ballast under, and at the ends of, the previously tamped ties while it settles the track at a lower level because of the reduced ballast volume. This dynamic track stabilization has been used with great success in track maintenance and rehabilitation.

Canadian patent No. 1,191,739, discloses the use of such track stabilization machines in a train of sequentially arranged track maintenance machines whose work may be synchronized and which may comprise an intermittently advancing track leveling, lining and tamping machine as well as continuously advancing track stabilization and ballast cleaning machines.

U.S. Pat. No. 4,643,101, dated Feb. 17, 1987, discloses a continuously advancing track leveling, lining and tamping machine equipped with a track stabilization assembly. This is a special type of a combined track tamping and stabilizing machine which frequently requires the subsequent use of a ballast plow to deliver ballast into the cribs since a portion of the crib ballast has been moved out of the cribs under the adjacent ties during the preceding track tamping and stabilizing operation.

U.S. Pat. No. 4,064,807, dated Dec. 27, 1977, discloses a non-stop track leveling and ballast compacting machine comprising a track leveling reference system. The machine frame carries a track lifting device for raising successive track sections as the machine continuously advances along the track, a plow for smoothing the ballast bed below the raised track sections and a track stabilizing ballast compactor trailing the plow in the operating direction. The machine frame is supported by front and rear undercarriages on the track and the plow is arranged centrally between the undercarriages. The plow has plowshares arranged to form two elongated raised ballast strips below the track rails and an intermediate strip recessed between the two raised strips so that the track ties will not "ride" on their ballast support. This combination of a track stabilization assembly with a plow moving under preceding raised track sections provides a firm, smooth ballast bed for the track, in contrast to such track surfacing machines as disclosed in U.S. Pat. No. 3,651 587, dated Mar. 28, 1972, and U.S. Pat. No. 4,282,663, dated Aug. 11, 1981, which are ballast plows with plow arrangements which are lowered into engagement with the ballast bed for smoothing the surface of the ballast supporting the track.

British Pat. No. 1,006,639, published Oct. 6, 1965, discloses an apparatus for clearing ballast from the center of the ballast bed towards the two rails, which comprises two vertically adjustable rotary devices with radially projecting, flexible ballast sweeping elements, the rotary devices being rotatable about axes extending in the direction of the track for displacing ballast into the areas of the rails where the ballast may be tamped under the ties.

SUMMARY OF THE INVENTION

It is the primary object of this invention to improve the ballast compaction of a continuously advancing track surfacing machine of the first-described type.

The above and other objects are accomplished in such a machine according to the invention with a vertically adjustable plow arrangement for smoothing the ballast bed mounted on the machine frame between the undercarriages and associated with the track stabilization assembly, the plow arrangement extending across the track at least from one of the tie ends to the opposite tie end, and a drive for vertically adjusting the plow arrangement into engagement with the ballast bed.

This combination of a track stabilization assembly, which compacts the ballast and correspondingly lowers the track level, and a ballast plow arrangement mounted on the same machine frame between the undercarriages thereof assures a proper ballast bed with a uniform ballast distribution for the leveled and stabilized track. Such a plow arrangement associated with the track stabilization assembly assures an adequate amount of ballast within the operating range of the track compaction so that a uniform track level can always be maintained. The track vibrations produced by the track stabilization assembly will enhance the flow of the ballast stones in the adjoining operating range of the plow arrangement whereby the ballast will be very uniformly distributed over the entire bed in a very simple and trouble-free manner. In addition, the machine saves construction and personnel costs, providing a particularly economical and efficient manner of fixing a leveled track in a desired position on a uniform ballast bed.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figures 1, 2, 3:
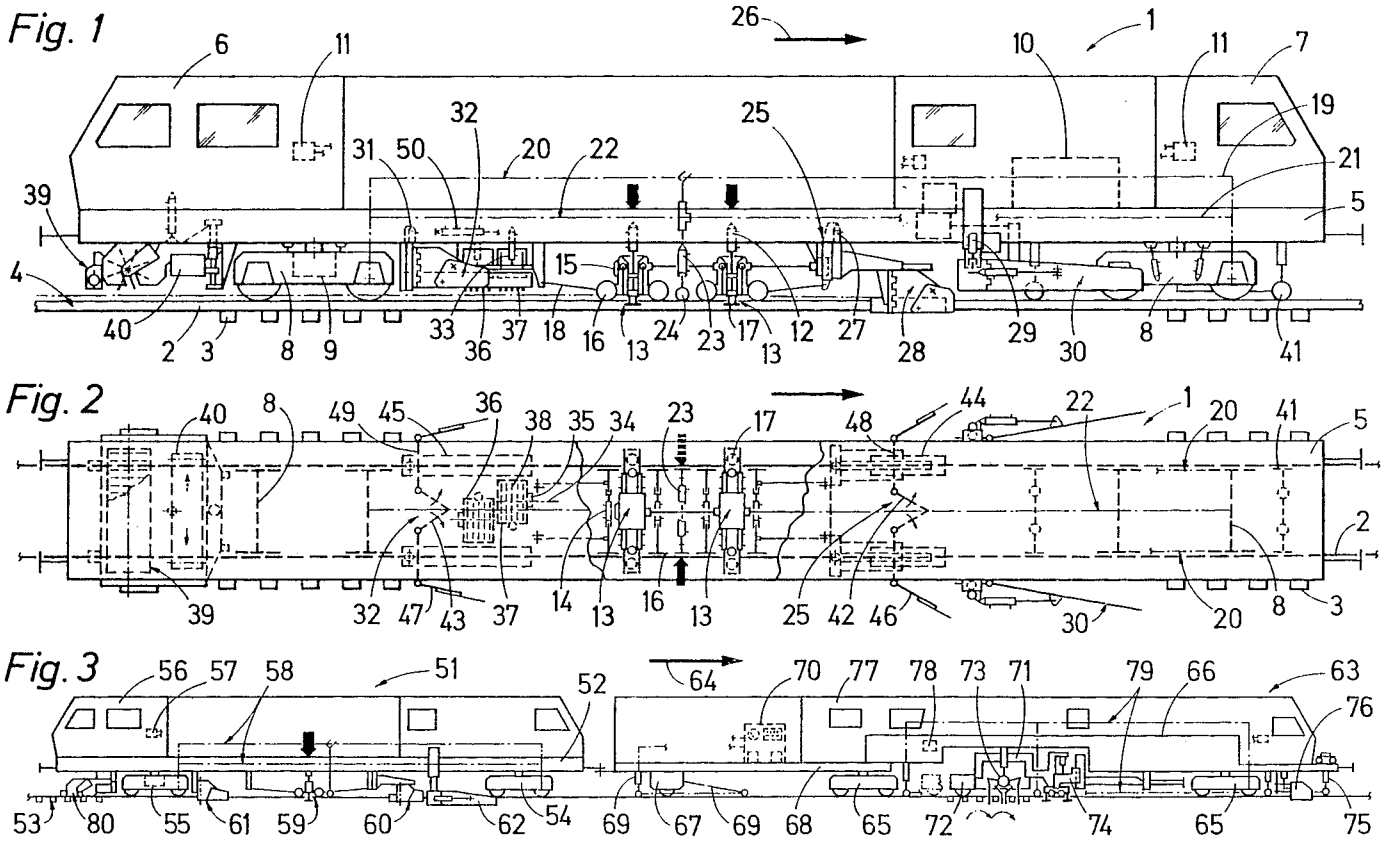
FIG. 1 is a side elevational view of a track surfacing machine according to one embodiment of the invention.
FIG. 2 is a top view of the machine of FIG. 1.
FIG. 3 is a side elevational view of another embodiment of the track surfacing machine coupled to a non-stop track leveling, lining and tamping machine.

Referring now to the drawing, FIGS. 1 and 2 shows continuously advacing track surfacing machine 1 for compacting a ballast bed supporting track 4 consisting of two rails 2 fastened to ties 3, the rails having facing gage sides and the ties having opposite ends. The machine comprises bridge-like machine frame 5 and front and rear undercarriages 8, 8 supporting the machine frame on track 4 for mobility in an operating direction indicated by arrow 26. The wheel base is large enough to enable the operating tools of the machine to be accommodated on the machine frame between the undercarriages. Operator's cabs 6 and 7 are mounted at respective ends of machine frame 5 which also carries central source of power 10 for all the operating drives of the machine, including drive 9 for propelling the machine frame along track 4. Each operator's cab houses a central control panel 11. In the embodiment of FIGS. 1 and 2, two power-actuated, vertically adjustable track stabilization assemblies 13, 13 are mounted on machine frame 5 between undercarriages 8. Each track stabilization assembly includes rail-engaging roller tools 16, spreading drives 14 for pressing the roller tools into engagement with the facing gage sides of rails 2 and means 15 for vibrating the roller tools. Drives 12 link the track stabilization assemblies to machine frame 5 for vertically adjusting each track stabilization assembly The two track stabilization assemblies are coupled together by coupling rods linking them to each other, additional coupling rods linking the track stabilization assemblies to the machine frame. The common vibrating means 15 imparts substantially horizontally extending vibrations to the roller tools which roll along the track rails and drives 12 exert a downward thrust on the assemblies. As more fully described and illustrated in U.S. Pat. Nos. 4,046,078 and 4,046,079, pivotal rail gripping tools 17 engage the field sides of the rails so that the track is firmly held by the track stabilization tools of the assemblies while it is vibrated and downwardly thrust. Track leveling reference system 20 including tensioned reference wire 19 monitors the track level, and the illustrated machine also comprises track lining reference system 22 including reference line 21 extending between the undercarriages and measuring axle 24 between and adjacent the track stabilization assemblies. Lining drives 23 are linked to the machine and are controlled by the track lining reference system. Sensing rollers 41 run on rails 2 in front and behind front undercarriage 8 to extend the reference base constituted by reference lines 19 and 21 or to provide a shorter reference base for other track parameters.

According to this invention, vertically adjustable plow arrangement 25 for smoothing the ballast bed is mounted on machine frame 5 between undercarriages 8 and is associated with track stabilization assemblies 13. The plow arrangement extends across track 4 at least from one to the opposite tie end, as shown in FIG. 2, and precedes the track stabilization assemblies in the operating direction. Drive 27 links ballast plow 28 of the plow arrangement to the machine frame for vertically adjusting the plow arrangement into engagement with the ballast bed. Plow arrangement 25 is comprised of two cooperating center plowshares 42 laterally pivotal about vertical axes into a forwardly projecting V-formation, respective transverse plowshare 48 having one end adjoining each center plowshare and extending across a respective rail 2, respective tunnel-shaped member 44 bridging each rail, transverse plowshares 48 being affixed to the tunnel-shaped members, and respective side plowshare 46 connected to an end of each transverse plowshare opposite the one end. Two shoulder plows 30 precede side plowshares 47 of plow arrangement 25 in the operating direction indicated by arrow 26 and independently operable drives 29 link the shoulder plows to the machine frame for vertically adjusting the shoulder plows.

The arrangement of two track stabilization assemblies increases the operating range of the ballast vibrations and causes the ballast stones to flow further into the operating range of preceding plow arrangement 25. The illustrated arrangement of the plowshares enables the ballast plowing to be readily adapted to a variety of ballast conditions so that the ballast may be uniformly distributed over the entire ballast bed while the machine continuously advances in the operating direction. The plow arrangement preceding the track stabilization assures an advantageous flow of the ballast distributed by the plowshares to the trailing track stabilization assembly.

As indicated in FIG. 1 by a window next to central source of power 10, a further operator's cab with a control panel may be arranged on machine frame 5 within view of the track stabilization assemblies 13 and plow arrangement 25 to observe and control the ballast plowing and track stabilization operations.

In the preferred embodiments of the present invention, another power-actuated, vertically adjustable plow arrangement 32 is mounted on machine frame 5 between undercarriages 8 and succeeds track stabilization assemblies 13 in the operating direction. This plow arrangement is substantially identical with that of plow arrangement 25 and comprises two cooperating center plowshares 43 laterally pivotal about vertical axes into a forwardly projecting V-formation, respective transverse plowshare 49 having one end adjoining each center plowshare and extending across a respective rail 2, respective tunnel-shaped member 45 bridging each rail, transverse plowshares 49 being affixed to the tunnel-shaped members, and respective side plowshare 47 connected to an end of each transverse plowshare opposite the one end. Drive 32 links plow arrangement 32 to the machine frame for vertically adjusting this plow arrangement. In addition, plow arrangement 32 comprises two transversely staggered, power-driven rotary brooms 36, 37 succeeding each other in the direction of the track. This broom arrangement increases the sweeping range of the brooms in the track direction. The brooms are rotatable about axes 34 extending in the direction of track 4 and are arranged between the two rails 2. Each broom has radially projecting, flexible sweeping elements 38 and is rotatable by a drive 35 and vertically adjustable into engagement with the ballast bed by a drive 33. This arrangement of ballast plow arrangements preceding and trailing the track stabilization assembly adds particular flexibility to the machine for operation under various ballast conditions requiring use of one or the other plow arrangements or the combined use of both plow arrangements. Plow arrangement 25 will assure a uniform distribution of sufficient ballast to track stabilization assembly 13 to produce a desired settling of the ballast bed to an accurate level, and the brooms of trailing plow arrangement 32 will not only enhance the planing of the ballast bed of the stabilized track but will also remove any excess ballast from the center of the track to prevent "riding" of the ties.

Track surfacing machine 1 further comprises vertically adjustable ballast sweeping arrangement 39 mounted on machine frame 5 behind rear undercarriage 8 in the operating direction. The ballast sweeping arrangement comprises a rotary broom extending across track 4 at least from one to the opposite tie end and transversely extending conveyor 40 arranged to receive ballast swept up by the broom and to convey the swept-up ballast to a respective track shoulder. In this way, this single track surfacing machine will not only economically produce a very accurate and long-lasting track level but will leave a clean track whose tie surfaces and rail fastening elements are free of ballast stones.

The operation of track surfacing machine 1 will now be described in detail:

When the operating site has been reached, drives 12, 29 and 31 are actuated to lower track stabilization assemblies 13 and plow arrangements 25 and 32 into their respective operating positions. Ballast sweeping arrangement 39 is also lowered into its operating position. At the same time, drives 33 are actuated to lower brooms 36, 37 into engagement with the ballast bed, the brooms are suitably spaced from center plowshares 43 of trailing plow arrangement 32 by actuating drives 50 linked to the brooms for longitudinal displacement thereof in the direction of the track and drives 35 are actuated to rotate the brooms about axes 34. The existing track level is monitored by lowering measuring axle 24 and sensing rollers 41 onto rails 2. Outer gripping tools 17 of track stabilization assemblies are pivoted into clamping engagement with the field sides of the rails and roller tools 16 constituted by flanged wheels are pressed into engagement with the facing gage sides of the rails so that rails 2 of track 4 are firmly clamped between stabilizer tools 16 and 17. Finally, drives 29 are actuated to lower shoulder plows 30 into their operating positions and drive 9 is actuated to start the continuous advance of track surfacing machine 1 in the operating direction indicated by arrow 26. During this continuous machine advance, vibrators 15 and drives 12 are actuated to impart horizontal vibrations and a strong downward thrust (see black arrows in FIG. 1) to track 4. As indicated by the black arrow in FIG. 2, lining drives 23 may also be actuated under the control of lining reference system 22 to line the track.

As the machine advances continuously along the track, the combined vibrations and downward pressure imparted to the track under the control of leveling and lining reference systems 20, 22 will accurately settle track 4 from its original position (shown in phantom lines in FIG. 1) into its desired level and also accurately line the track at this level. The two plow arrangements will produce a uniform flow of ballast to the track stabilization assemblies so that the same will have available a sufficient amount of ballast for their proper operation at all times, thus producing a uniformly compacted ballast bed with a smooth surface configuration. For example, if there is not enough ballast present at the track stabilization assemblies, shoulder plows 30 and/or side plowshares 46 and/or center plowshares 42 may be suitably pivoted about their vertical pivoting axes to distribute additional ballast from the track shoulders into the center area of the track and, more particularly, to the track areas where the ties and rails intersect. On the other hand, excessive ballast may be removed from the center track area by suitably pivoting the center and side plowshares so as to cause such excessive ballast to flow towards the track shoulders. Any excessive ballast between track rails 2 is swept to the sides of the stabilized track by rotating brooms 36, 37. Such ballast is then smoothed along the rails by transverse plowshares 49 and flows towards side plowshares 47 whose lower edges extend obliquely to the track bed plane to provide the conventional incline of the track shoulders. Finally, ballast stones on the ties and rail fastening elements are swept up by the rotating broom of ballast sweeping arrangement 39 and are thrown onto transverse conveyor 40 which conveys these ballast stones to the track shoulders.

In the embodiment illustrated in FIG. 3, continuously advancing track surfacing machine 51 is coupled to continuously advancing track leveling, lining and tamping machine 63 preceding the track surfacing machine in the operating direction indicated by arrow 64. The track surfacing machine comprises machine frame 52 and front and rear undercarriages 54, 54 supporting the machine frame on track 53, drive 55 propelling the machine frame along the track in an operating direction indicated by arrow 64. As in track surfacing machine 1, operator's cabs 56 with central control panels 57 are mounted at each end of the machine frame and another operator's cab is arranged within view of the operating tools of the machine. Power-actuated, vertically adjustable track stabilization assembly 59 of the same structure as assemblies 13 is mounted on the machine frame between the undercarriages, and a respective plow arrangement 60, 61 of the same structure as plow arrangements 25, 32 precedes and trails this track stabilization assembly. The track level and line is monitored by leveling and lining reference system 58 including a level reference wire and a line reference wire as well as a measuring axle adjacent track stabilization assembly 59. Lining drives are linked to the machine frame and are controlled by the track lining reference system. Also as in machine 1, vertically and laterally adjustable shoulder plows 62 are mounted on the machine frame immediately behind front undercarriage 54 in the operating direction and a vertically adjustable ballast sweeping arrangement is mounted on the machine frame behind the rear undercarriage. The combined work of continuously advancing machines 63 and 51 very economically and efficiently produces a long-lasting, accurate track level and line in a single pass of the machines. It is particularly useful for surfacing track sections where only relatively short time spans are available for work between passing trains.

Continuously advancing track leveling, lining and tamping machine may be of a generally conventional structure and comprises elongated, bridge-like machine frame 66 supported by swivel trucks 65 for mobility on track 53. An extended machine frame portion 68 projects rearwardly from rear swivel truck 65 and is supported on the track by single-axle undercarriage 67. The rearwardly projecting frame portion carries vertically adjustable track measuring devices 69 and measurement and recording instruments 70 for such track parameters as gage, track torsion and other control measurements. Tool carrier frame 71 is arranged between widely spaced swivel trucks 65, 65 and has a forwardly projecting central pole linked to machine frame 66 and a rear end supported on the track by single axle undercarriage 72. A drive for intermittently longitudinally displacing the tool carrier frame connects the tool carrier frame to the machine frame. Tamping head 73 with adjacent pairs of reciprocatory and vibratory tamping tools for simultaneously tamping two adjacent ties is vertically adjustably mounted on tool carrier frame 71 immediately adjacent undercarriage 72 and vertically and laterally adjustable track lifting and lining tool means 74 is mounted on the tool carrier frame ahead of the tamping head in the operating direction. Laser measuring device 75 is mounted at the front end of the machine frame and vertically adjustable ballast plow 76 is mounted on the machine frame between the laser measuring device and front swivel truck 65. Operator's cab 77 housing central control panel 78 is mounted on machine frame 66 within view of the tamping head and track lifting and lining tool means. The level and line of the track is monitored by track leveling and lining reference system 79 which controls the lifting and lining of the track.

In operation machines 63 and 51 are continuously advanced together along track 53 in an operating direction indicated by arrow 64 while the longitudinal displacement drive linking tool carrier frame 71 to machine frame 66 is cyclically actuated so that it will stand still at each tamping station (see small arcuate arrows schematically indicating this intermittent movement) to permit the ties to be tamped while the machines continuously advance and correct the track position. Various track parameters of the leveled, lined and tamped track are registered by the reference system constituted by the two vertically adjustable measuring devices 69 on rear frame portion 68 and recorded on device 70. Front ballast plow 76 distributes ballast over the track bed and particularly to the areas where the ties and rails intersect so that sufficient ballast will be available for tamping ballast under the ties in these areas by the tamping tools of succeeding tamping head 73. The leveled, lined and tamped track will then be settled into its final position by the controlled operation of trailing track surfacing machine 51 in the same manner as described in connection with the embodiment of FIG 1.

What is claimed is:

1. A continuously advancing track surfacing machine for compacting a ballast bed supporting a track consisting of two rails fastened to ties, the rails having facing gage sides and the ties having opposite ends, which comprises (a) a machine frame, (b) front and rear undercarriages supporting the machine frame on the track of mobility in an operating direction, (c) a drive for propelling the machine frame along the track, (d) a power actuated, vertically adjustable track stabilization assembly mounted on the machine frame between the undercarriages, the track stabilization assembly including (1) rail-engaging roller tools, (2) drive means for pressing the roller tools into engagement with the facing gage sides of the rails and (3) means for vibrating the roller tools, (e) a drive for vertically adjusting the track stabilization assembly, (f) a track leveling reference system monitoring the track level, (g) a vertically adjustable plow arrangement for smoothing the ballast bed mounted on the machine frame between the undercarriages and associated with the track stabilization assembly, the plow arrangement extending across the track at least from one of the tie ends to the opposite tie end, and (h) a drive for vertically adjusting the plow arrangement into engagement with the ballast bed.

2. The continuously advancing track surfacing machine of claim 1, comprising two of said track stabilization assemblies, the track stabilization assemblies being coupled together and a common drive means vibrating the roller tools of the coupled assemblies, the plow arrangement preceding the track stabilization assemblies in the operating direction and being comprised of two cooperating center plowshares laterally pivotal about vertical axes, a respective transverse plowshare having one end adjoining each center plowshare and extending across a respective one of the rails, a respective tunnel-shaped member bridging each rail, the transverse plowshares being affixed to the tunnel-shaped members, and a respective side plowshare connected to an end of each transverse plowshare opposite the one end, and further comprising two shoulder plows preceding the side plowshares of the plow arrangement in the operating direction and independently operable drives for vertically adjusting the shoulder plows.

3. The continuously advancing track surfacing machine of claim 1, wherein the plow arrangement precedes the track stabilization assembly in the operating direction, further comprising another power-actuated, vertically adjustable plow arrangement mounted on the machine frame between the undercarriages and succeeding the track stabilization assembly in the operating direction.

4. The continuously advancing track surfacing machine of claim 3, wherein the other plow arrangement comprises at least one power-driven rotary broom rotatable about an axis extending in the direction of the track and arranged between the two rails, the broom having radially projecting, flexible sweeping elements, and a drive for vertically adjusting the broom into engagement with the ballast bed.

5. The continuously advancing track surfacing machine of claim 1, further comprising a vertically adjustable ballast sweeping arrangement mounted on the machine frame behind the rear undercarriage in the operating direction, the ballast sweeping arrangement comprising a rotary broom extending across the track at least from one to the opposite tie end and a transversely extending conveyor arranged to receive ballast swept up by the broom and to convey the swept-up ballast to a respective track shoulder.

6. The continuously advancing track surfacing machine of claim 1, wherein the plow arrangement precedes the track stabilization assembly in the operating direction and the track surfacing machine is coupled to a continuously advancing track leveling, lining and tamping machine preceding the track surfacing machine in the operating direction, further comprising a track lining reference system including a reference line extending between the undercarriages and a measuring axle adjacent the track stabilization assembly, and lining drives linked to the machine frame and controlled by the track lining reference system.

* * * * *